US008523349B2

(12) United States Patent
Yu

(10) Patent No.: US 8,523,349 B2
(45) Date of Patent: Sep. 3, 2013

(54) PORTABLE PRINTER

(75) Inventor: Chang-Lung Yu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 137 days.

(21) Appl. No.: 13/206,526

(22) Filed: Aug. 10, 2011

(65) Prior Publication Data

US 2012/0306980 A1 Dec. 6, 2012

(30) Foreign Application Priority Data

Jun. 1, 2011 (TW) ..... 100119144 A

(51) Int. Cl.

| | |
|---|---|
| ***B41J 29/13*** | (2006.01) |
| ***B41J 2/165*** | (2006.01) |
| ***B41J 2/175*** | (2006.01) |
| ***B41J 2/01*** | (2006.01) |

(52) U.S. Cl.
USPC ..... 347/108; 347/22; 347/85; 347/101

(58) Field of Classification Search
None
See application file for complete search history.

(56) References Cited

U.S. PATENT DOCUMENTS 5,731,829 A * 3/1998 Saito et al. ..... 347/104
7,884,963 B2 * 2/2011 Silverbrook et al. ..... 358/1.18

* cited by examiner

*Primary Examiner* — Stephen Meier
*Assistant Examiner* — Alexander C Witkowski
(74) *Attorney, Agent, or Firm* — Altis Law Group, Inc.

(57) ABSTRACT

A portable printer includes an outer housing, a circuit board, a battery, an inner housing, at least one inkjet head, and a motor, all of which are housed in the outer housing. The outer housing defines a longitudinal receiving space and an opening communicating with the receiving space. The battery is electrically connected to the circuit board to provide power to the portable printer. The inner housing can rotate around an axis of the outer housing. The inkjet head can rotate with the inner housing, and emits ink when it rotates. The motor is electrically connected to the circuit board, and is controlled by the circuit board to drive the inner housing to rotate. The rotation of the inner housing drives the inkjet head to rotate. Ink from the inkjet head goes out of the outer housing through the opening.

9 Claims, 3 Drawing Sheets

PORTABLE PRINTER

BACKGROUND

1. Technical Field

The present disclosure relates to printers and, particularly, to a portable printer.

2. Description of Related Art

Standard printers are generally too big and heavy to carry around. Furthermore, many printers require the use of a computer to set up any special printing requirements such as aligning printed content to specific areas on a printing paper, which can be troublesome to users.

BRIEF DESCRIPTION OF THE DRAWINGS

The components of the drawings are not necessarily drawn to scale, the emphasis instead being placed upon clearly illustrating the principles of a portable printer. Moreover, in the drawings, like reference numerals designate corresponding parts throughout several views.

DETAILED DESCRIPTION

Figure 1:
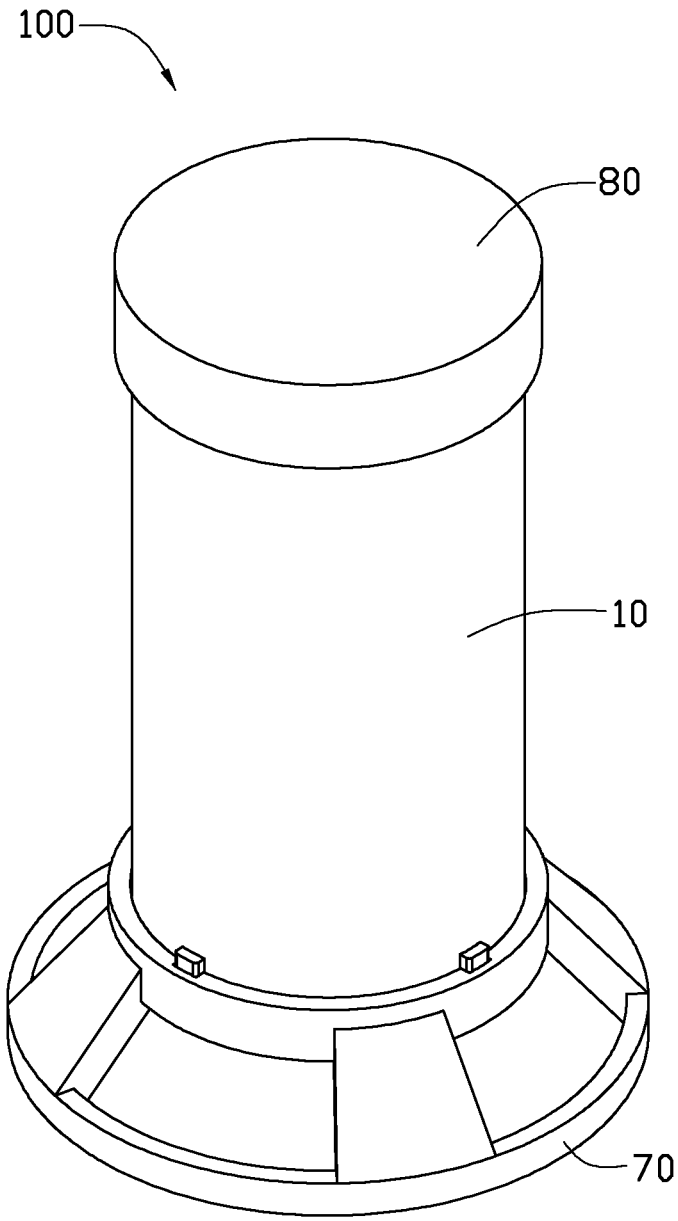
FIG. 1 is an isometric view of a portable printer in accordance with an exemplary embodiment.
Figure 2:
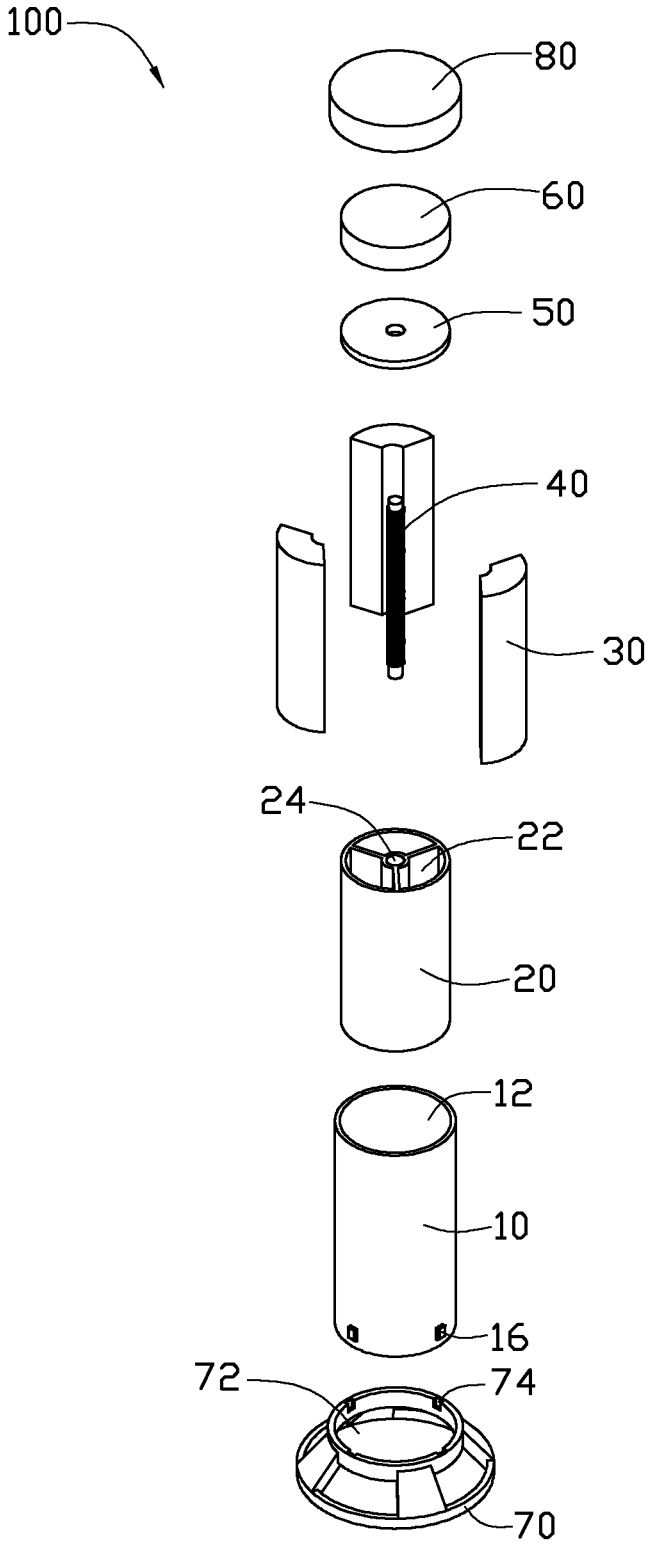
FIG. 2 is an exploded, perspective view of the portable printer of FIG. 1.
Figure 3:
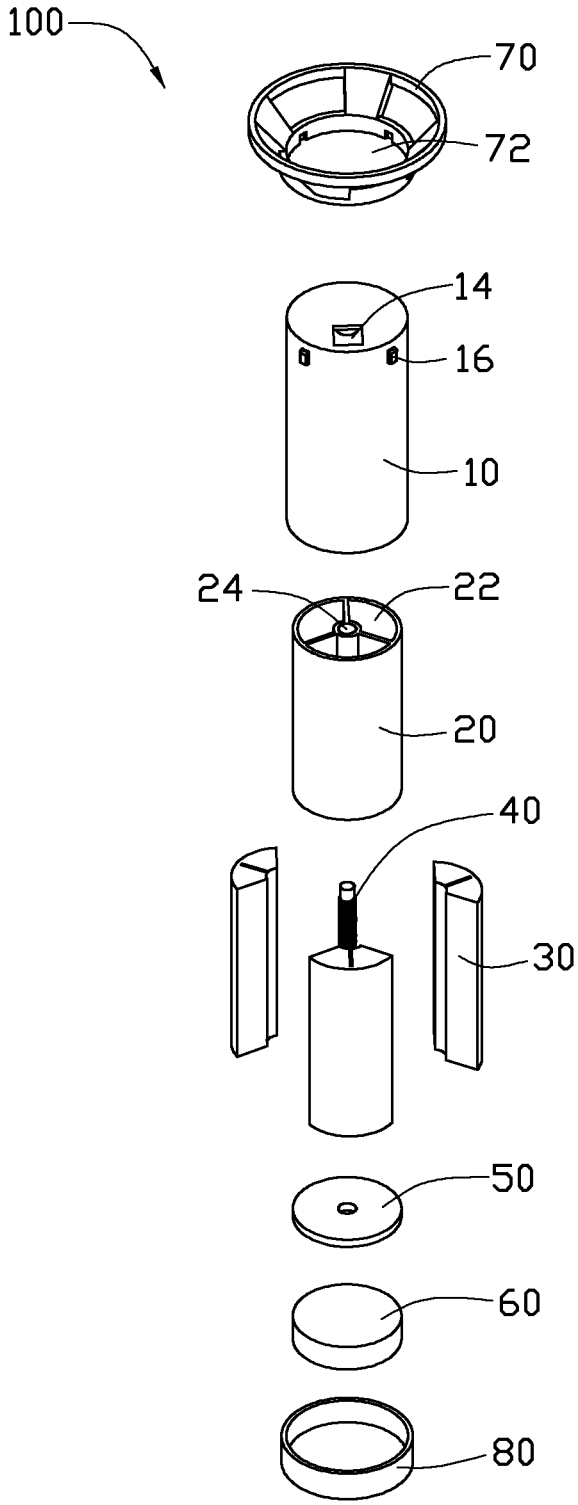
FIG. 3 is another exploded, perspective view of the portable printer of FIG. 1, but viewed from a different perspective.

Referring to FIGS. 1-3, a portable printer 100 includes an outer housing 10 an inner housing 20, at least one inkjet head 30, a motor 40, a circuit board 50, and a battery 60, all of which are housed in the outer housing 10. The battery 60 is electrically connected to the circuit board 50 to provide power to the printer 100. The outer housing 10 defines a receiving space 12 along a longitudinal side of the outer housing 10. The outer housing 10 includes a bottom surface defining an opening 14 communicating with the receiving space 12. The inner housing 20 is received in the receiving space 12 and can be driven to rotate around an axis of the outer housing 10. The inkjet head 30 is arranged within the inner housing 20 and can rotate with the inner housing 20. The inkjet head 30 can emit ink when it rotates. Ink from the inkjet head 30 goes out of the outer housing 10 through the opening 14. The motor 40 is electrically connected to the circuit board 50. The motor 40 is controlled by the circuit board 50 to drive the inner housing 20 to rotate. The rotation of the inner housing 20 drives the inkjet head 30 to rotate. The inkjet head 30 can emit ink when it rotates, and ink from the inkjet head 30 goes out of the outer housing 10 through the opening 14. In this embodiment, the outer housing 10 and the inner housing 20 are substantially cylindrical. The motor 40 is a direct current (DC) motor.

In this embodiment, the printer 100 includes three inkjet heads 30 respectively having red, green, blue ink therein. The inner housing 20 defines three longitudinal receiving cavities 22 and a shaft hole 24 arranged among the receiving cavities 22. Each receiving cavity 22 receives one inkjet head 30. The motor 40 passes through the shaft hole 24 to be electrically connected to the circuit board 50.

The printer 100 further includes a base 70 latched to the outer housing 10. The base 70 defines a longitudinal through hole 72 communicating with the opening 14. The base 70 further defines a number of recesses 74 extending from the top of the base 70 and communicating with the through hole 72. A number of projections 16 protrudes from the outer sidewall of the outer housing 10 and are adjacent to the bottom of the outer housing 10. There are an equal number of the projections 16 and the recesses 74. Each projection 16 can be received in one recess 74 to latch the outer housing 10 to the base 70. The printer 100 further includes a cover 80 latched to the top of the outer housing 10.

In this embodiment, the printer 100 can communicate with an external device for example a computer through wire or wireless means. To print desired content in a designated region of a paper with the printer 100, the printer 100 is placed on the paper to cause the opening 14 to be above the designated region of the paper. For example, to print a name in a signature region of a document, the printer 100 is placed on the document to cause the opening 14 to be above the signature region. After the printer 100 is in place, a user can operate an external device communicating with the printer 100 to transmit a print command to the printer 100. Upon receiving the print command, the circuit board 50 controls the motor 40 to drive the inner housing 20 to rotate, and ink from the ink head 30 goes out of the outer housing 10 to print the name on the signature region of the document.

In this embodiment, the structure of the printer 100 is simple and the volume of the printer 100 is relatively small, thus the printer 100 is small and has a simple structure making it very portable and easy to use.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A portable printer comprising:

an outer housing defining a longitudinal receiving space, and an opening in a bottom surface of the outer housing and communicating with the receiving space;

a circuit board housed in the outer housing;

a battery housed in the outer housing and electrically connected to the circuit board to provide power to the portable printer;

an inner housing housed in the outer housing and being able to rotate around an axis of the outer housing;

at least one inkjet head housed in the inner housing and being able to rotate with the inner housing, the at least one inkjet head being able to emit ink when the at least one inkjet head rotates, ink from the at least one inkjet head going out of the outer housing through the opening; and a motor housed in the outer housing and electrically connected to the circuit board, the motor being controlled by the circuit board to drive the inner housing to rotate.

2. The portable printer as described in claim 1, wherein the inner housing defines a longitudinal shaft hole, the motor passes through the shaft hole to be electrically connected to the circuit board.

3. The portable printer as described in claim 2, wherein the motor is a direct current motor.

4. The portable printer as described in claim 1, wherein the at least one inkjet head comprises three inkjet heads, the inner housing defines three longitudinal receiving cavities, each of the cavities receives one of the inkjet heads.

5. The portable printer as described in claim 1, wherein the inkjet heads respectively have red, green, blue ink therein.

6. The portable printer as described in claim 1, further comprising a base latched to the bottom of the outer housing, wherein the base defines a longitudinal through hole communicating with the opening.

7. The portable printer as described in claim 1, further comprising a cover latched to a top of the outer housing.

8. The portable printer as described in claim 1, wherein the outer housing and the inner housing are substantially cylindrical.

9. The portable printer as described in claim 1, wherein the portable printer communicates with an external device through wire or wireless means.

* * * * *